United States Patent [19]

Schimmel

[11] 4,235,560

[45] Nov. 25, 1980

[54] TRANSITION BOLT FOR CLAMPING TOGETHER THE SIDE RAILS OF CONCRETE WALL FORM PANELS OR THE LIKE

[75] Inventor: Vernon R. Schimmel, Arlington Heights, Ill.

[73] Assignee: Symons Corporation, Des Plaines, Ill.

[21] Appl. No.: 761,245

[22] Filed: Jan. 21, 1977

Related U.S. Application Data

[62] Division of Ser. No. 705,086, Jul. 14, 1976, Pat. No. 4,030,694.

[51] Int. Cl.[3] ..... E04G 17/04; F16B 35/04

[52] U.S. Cl. ..... 403/388; 85/1 L; 85/9 R

[58] Field of Search ..... 85/1 L, 1 H, 9 R; 151/44, 33; 249/214, 195, 175, 217, 41, 45; 403/388

[56] References Cited

U.S. PATENT DOCUMENTS

| | | | |
|---|---|---|---|
| 1,251,772 | 1/1918 | Guett | 85/1 L |
| 1,959,741 | 5/1934 | Simpson | 151/33 |
| 1,967,145 | 7/1934 | Fisher | 151/68 |
| 2,620,832 | 12/1952 | Alix et al. | 85/1 L |
| 2,820,972 | 1/1958 | Ptak | 85/1 L |
| 3,127,625 | 4/1964 | Ruminsky | 85/1 L |
| 3,724,886 | 4/1973 | Widerby | 85/1 L |
| 3,855,895 | 12/1974 | Francis | 85/1 L |
| 3,903,443 | 9/1975 | Carlson | 85/1 H |

FOREIGN PATENT DOCUMENTS

| | | | |
|---|---|---|---|
| 978964 | 12/1950 | France | 85/9 R |
| 1207937 | 9/1959 | France | 151/44 |
| 1376918 | 9/1964 | France | 85/1 L |
| 429653 | 2/1948 | Italy | 85/9 R |

*Primary Examiner*—Roy D. Frazier
*Attorney, Agent, or Firm*—Gerlach & O'Brien

[57] ABSTRACT

A transition bolt for clamping together the side rails of a pair of edge-to-edge concrete wall form panels or the like comprises an enlarged head portion, a reduced shoulder portion, and a further reduced shank portion and is characterized by the fact that the shoulder and shank portions are flat-sided and have their sides coplanar and the shank portion is formed with interrupted screw threads along its edges for reception thereover of a threaded nut.

2 Claims, 4 Drawing Figures

TRANSITION BOLT FOR CLAMPING TOGETHER THE SIDE RAILS OF CONCRETE WALL FORM PANELS OR THE LIKE

The present application is a division of my co-pending United States patent application Ser. No. 705,086, filed on July 14, 1976, and entitled "COMPOSITE CONCRETE WALL FORM UNIT WITH A SPECIAL TRANSITION BOLT" such application now being U.S. Pat. No. 4,030,694, dated June 21, 1977.

The present invention relates generally to concrete wall forms and has particular reference to a concrete wall form of the type which comprises a pair of upstanding spaced apart sides for receiving poured wet concrete therebetween for wall-forming purposes, each side being in the form of a composite unit and embodying a series of rectangular prefabricated panels which are arranged in edge-to-edge and upstanding relationship, each panel consisting of a rectangular plywood facing and a metal-reinforcing or backing frame. For convenience of description herein, such panels will be referred to as metal-clad panels. Apart from their longitudinal (vertical) and transverse (horizontal) dimensions, metal-clad panels are manufactured in different sizes, which is to say that the top, bottom, and side rails of their reinforcing frames are of different gauge metal stock. For example, Symons Corporation of Des Plaines, Ill. has for many years manufactured and sold a steel-clad panel which is known in the trade as a "Steel-Ply" panel wherein the rectangular plywood panel facing is of the three-ply variety and the rectangular reinforcing frame is constructed of appropriate gauge steel stock. Symons Corporation also manufactures and sells another steel-clad panel which is commonly known as a "Versiform" panel wherein the plywood facing is of the five-ply variety and the reinforcing frame is constructed of a much heavier gauge steel stock. The width of the top, bottom, and side rails of the reinforcing frame of a "Versiform" panel in a direction normal to the plywood facing is also considerably greater than is the width of the corresponding top, bottom, and side rails of the reinforcing frame of a "Steel-Ply" panel. Moreover, in a "Steel-Ply" panel, the three-ply panel plywood facing is set in a continuous marginal recess in the reinforcing frame, whereas in a "Versiform" panel, the five-ply plywood panel facing is not set in a marginal recess, but instead, is placed directly against the front or inner edges of the top, bottom, and side rails of its reinforcing frame.

It frequently happens that when a particular concrete wall form is constructed, in the main, from the larger "Versiform" panels, an odd dimension is left between two adjacent "Versiform" panels. This is the case because "Versiform" panels are made with but few variations in width. "Steel-Ply" panels on the other hand are made in a wide variety of different widths. Consequently, situations often arise where a "Steel-Ply" panel of a particular size or width will match the width of the odd dimension that must be made up in connection with a wall form employing "Versiform" panels. However, the fastening facilities which are currently available for connecting "Steel-Ply" panels to each other, or those which are available for connecting "Versiform" panels to each other are not suitable for connecting a "Steel-Ply" panel to a "Versiform" panel for fill-in use and, therefore, it has been necessary to devise special fill-in arrangements whenever such an odd dimension is encountered in the formation of a concrete wall form of the type under consideration. Another and equally important limitation which has prevented the use of a "Steel-Ply" panel as a fill-in panel is the fact that the non-recessed plywood facings of the two flanking "Versiform" panels and the recessed plywood facing of the medial "Steel-Ply" panel, as heretofore explained, are not conducive to panel facing continuity, the three-ply plywood facing of the "Steel-Ply" panel being set back on the order of three-fourths of an inch, which is the normal thickness of the five-ply plywood facing of a "Versiform" panel.

The present invention is designed to overcome both of these limitations that are attendant upon the use of a conventional "Steel-Ply" panel as a fill-in panel for a concrete wall form which is made up primarily of "Versiform" panels. Accordingly, insofar as the fastening facilities for effecting a connection between a "Steel-Ply" panel and an adjacent "Versiform" panel are concerned, the present invention affords a novel transition bolt and nut assembly which is capable of application to the registering but not similarly shaped openings which are ordinarily provided in the side rails of both the reinforcing frames of the "Steel-Ply" and the adjacent "Versiform" panels, such bolt and nut assembly, when properly applied to the two panels, serving securely and efficiently to clamp the adjacent or abutting frame side rails together. Insofar as the establishment of panel continuity between the plywood facing of the "Steel-Ply" panel and the panel facings of the two adjacent "Versiform" panels is concerned, the present invention contemplates the provision of a novel assembly of the three panels wherein a common five-ply plywood facing is provided for the reinforcing frames of both "Versiform" panels, such common plywood facing bridging the odd dimension that is filled-in with the three-ply plywood facing of the "Steel-Ply" panel and also fitting directly against the last-mentioned facing. Stated otherwise, the completed "Steel-Ply" panel including its three-ply plywood facing is employed structurally as a fill-in member for the odd dimension void or space, while the common plywood facing for the two "Versiform" panels establishes the continuous fill-in portion of the wall form side against which the wet concrete is poured. By such an arrangement, no alteration or modification of the "Steel-Ply" panel need be resorted to in order to adapt it to its fill-in use, nor is any alteration to the two "Versiform" panels necessary other than to equip them with the common five-ply plywood facing.

The provision of a composite three-panel assembly or unit such as has briefly been outlined above, and possessing the stated advantages, constitutes one of the principal objects of the present invention. Another and equally important object is the provision of a novel transition bolt as also briefly outlined above and having facilities whereby it will accommodate the slots or openings which are ordinarily formed in the side rails of the reinforcing frames of both the "Steel-Ply" and the "Versiform" panels and effect positive clamping of the frame side rails of adjacent panels together.

Various other objects and advantages of the invention not at this time enumerated will readily suggest themselves as the nature of the invention is better understood from a consideration of the following detailed description.

The invention consists in the several novel features which are hereinafter set forth and are more particularly defined by the claims at the conclusion hereof.

In the accompanying single sheet of drawings forming a part of this specification, one illustrative embodiment of the improved composite three-panel concrete wall form unit or assembly and two embodiments of the associated special transition bolt are illustrated.

In these drawings:

FIG. 1 is a fragmentary outside perspective view of a portion of a concrete wall form illustrating the manner in which the side rails of the reinforcing frame of a conventional "Steel-Ply" panel are operatively connected to the side rails of the reinforcing frames of a pair of adjacent conventional "Versiform" panels by utilization of the transition bolt of the present invention, the assembly of three panels constituting a novel fill-in concrete wall form unit;

Figure 1:
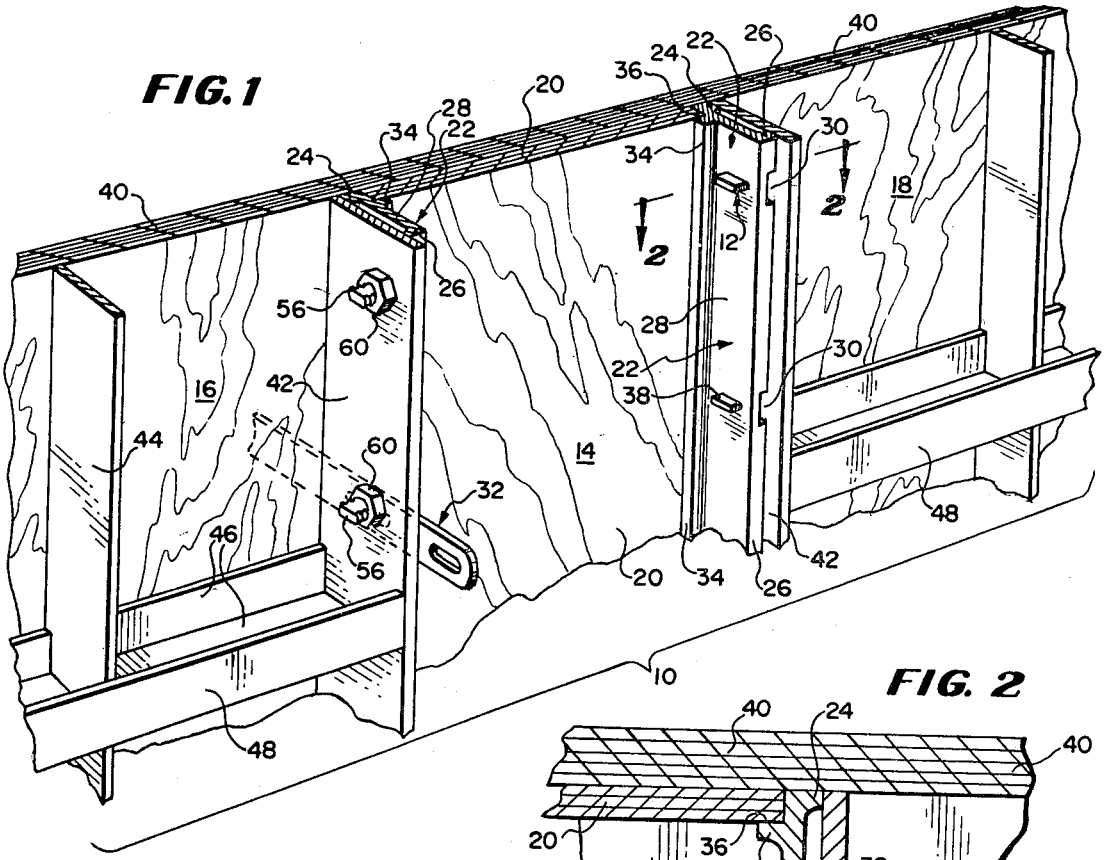

Referring now to the drawings in detail and in particular to FIG. 1, the novelty of the present invention is two-fold and consists of a special type of composite concrete wall form unit or assembly which is fragmentarily shown throughout the drawings and is designated in its entirety by the reference numeral 10, and also a special type of transition bolt which is designated by the reference numeral 12 and by means of which a plurality of wall form panels having different shape or size characteristics may be secured together in operative relationship to establish the composite concrete wall form unit or assembly 10.

Briefly, the composite concrete wall form unit or assembly 10 of the present invention embodies a conventional "Steel-Ply" panel which is joined in edge-to-edge relationship to the adjacent side rails of the reinforcing frames of a pair of metal-clad "Versiform" type panels, there being one of the last-mentioned panels on each side of the "Steel-Ply" panel. The metal-clad panels are provided with a common panel facing, all in a manner and for purposes that will become clear when the nature of the invention is better understood.

Before entering into a description of the specific nature of the composite concrete wall form unit or assembly 10, it is deemed pertinent to point out that the word or term "metal-clad" as employed herein, as well as in the accompanying claims, refers to any concrete wall form panel which embodies a rectangular plywood or other facing, together with a rectangular or marginal reinforcing frame of steel or other suitable metal. The "Steel-Ply" panel which is mentioned above is actually, in itself, a steel-clad panel but is referred to herein as a "Steel-Ply" panel in order to distinguish it more readily from the metal-clad "Versiform" type panels on opposite sides thereof. It is also referred to as a "Steel-Ply" panel because it is of a more or less specific nature which, as previously stated, constitutes a concrete wall form panel which has long been manufactured and sold by Symons Corporation of Des Plaines, Ill. On the other hand, the two metal-clad panels on the opposite sides of the "Steel-Ply" panel may vary widely, the only criterion being that they each include a panel facing which is carried by a rectangular or marginal reinforcing frame of steel or other suitable metal.

The central or medial "Steel-Ply" panel is designated in its entirety by the reference numeral 14, while the two metal clad panels at the side thereof are, respectively, designated by the reference numerals 16 and 18. All three of the panels 14, 16 and 18 are prefabricated panels in that they are assembled or put together at the factory rather than in the field.

The illustrated "Steel-Ply" concrete wall form panel 14 consists of a rectangular plywood facing 20 of the three-ply variety and has a marginal or rectangular steel reinforcing frame applied to the rear or outer side of the facing 20, the latter including vertical and horizontal side rails or frame bars, only the vertical side rails 22 being illustrated in the drawings. Specifically, the vertical side rails 22 are in the form of structural steel members which are generally of shallow U-shape cross section and each includes spaced apart, parallel, vertically extending marginal ribs 24 and 26 and a connecting base or web portion 28. At vertically spaced regions along each vertical side rail 22, the ribs 24 and 26 are notched as at 30 in order to accommodate the adjacent end portions of conventional tie rods at selected levels, only one such tie rod 32 being illustrated in the drawings hereof. On the sides of the side rail web portions 28, which are opposite the ribs 24 and 26, there are formed shallow vertically extending ribs 34 which define vertically extending grooves 36 in the front or inner marginal portions of the side rails 22 of the reinforcing frame for reception therein of the side marginal portions of the three-ply plywood facing 20. The web portions 28 of the side rails 22 have formed therein rectangular horizontally extending slots 38 and these are in horizontal register with the notches 30 and are for reception therethrough of conventional connecting bolt and wedge assemblies by means of which adjacent "Steel-Ply" concrete wall form panels may be connected together in a concrete wall form consisting of all "Steel-Ply" panels. The slots 38 are generally vertically spaced on twelve-inch centers in the usual manner of "Steel-Ply" panel construction. The "Steel-Ply" panel 14 may have associated therewith horizontal frame bars or struts of angle shape design, such frame bars extending between the side rails 22 at appropriate levels and welded thereto. No such frame bars or struts are illustrated in the drawings hereof, but for a fuller understanding of the nature of a conventional "Steel-Ply" panel, its associated frame bars or struts, and also of its use in connection with a tie rod bolt and wedge clamping assemblies, reference may be had to U.S. Pat. No. 2,948,045, granted on Aug. 9, 1960, and entitled "TIE ROD ASSEMBLY FOR CONCRETE WALL FORMS AND CONE THEREFOR." The entire disclosure of such patent is hereby incorporated in and made a part of the present specification insofar as it is consistent with the present disclosure.

Since the illustrated "Steel-Ply" panel 14 of the composite concrete wall form unit or assembly 10 is not connected to an adjacent "Steel-Ply" panel but rather to a different form of metal-clad panel, the slots 38 are not functional except at the particular selected locations where tie rods like the tie rod 32 are to be used.

Although, as previously stated, the transition bolt 12 may be employed for connecting a "Steel-Ply" panel such as the panel 14 to a wide variety of other metal-clad panels, the particular metal-clad panels 16 and 18 which have been selected for illustration in the drawings hereof are of a type which, like the "Steel-Ply" panel 14, is manufactured and sold by Symons Corporation under the trade name or designation "Versiform." Because of the shape characteristics of a "Versiform" concrete wall form panel wherein the rectangular reinforcing frame for the plywood panel is appreciably wider in the transverse direction of its various frame members than are the side rails 22 of the rectangular reinforcing frame of the "Steel-Ply" panel 14, and because of the fact that the plywood panel facing of a "Versiform" panel is not set in recesses such as the grooves 36 in the front or inner marginal portions of the side rails 22 of the reinforcing frame of the "Steel-Ply" panel 14, it is not feasible to connect a conventional "Versiform" panel to a "Steel-Ply" panel so that the inner sides or faces of their respective panel facings extend in coplanar fashion. The reason for this is because accurate alignment of the facings of adjacent concrete wall form panels would entail precision alignment by highly skilled labor and great difficulty would be encountered in effecting a perfect seal against concrete seepage at the lines of juncture between adjacent panels, all as will become more readily apparent when the nature of the metal-clad "Versiform" panels 16 and 18 is better understood. Accordingly, the composite concrete wall form unit or assembly 10 of the present invention utilizes only the steel reinforcing or backing frames of the two "Versiform" panels 16 and 18 and, in order to span the distance between the two spaced apart frames, a common five-ply panel facing 40 is associated with both of such frames and bridges the "Steel-Ply" panel 14. As shown in FIG. 1 of the drawings, such facing 40 lies flat against and is coextensive with the three-ply plywood facing 20 of the "Steel-Ply" panel 14. In this position, the vertical side rails 22 of the reinforcing frame of the "Steel-Ply" panel 14 are disposed in contiguity with the adjacent vertical side rails of the reinforcing frames of the two "Versiform" panels 16 and 18 and are secured thereto by the transition bolts 12, all in a manner that will be set forth subsequently.

Considering now the nature of the "Versiform" panels 16 and 18, the rectangular reinforcing or backing frame of each such panel comprises a plurality of vertical frame members including outside side rails 42 and inside frame members or rails 44, and also top and bottom horizontal frame members or rails (not shown), together with angle-shaped horizontal frame bars or struts 46 which extend between adjacent vertical frame members or rails at appropriate levels in the panel structure. The outside vertical side rails 42 are slightly wider than the inside frame members or rails 44. Horizontal backing strips 48 have their opposite ends abutting against the side rails 42 and their medial regions secured to the outer rear edges of the inside frame members or rails 44.

Ordinarily, apart from the novel wall form panel assembly 10 of the present invention, since a "Versiform" or other similar metal clad concrete wall form panel other than a "Steel-Ply" panel 14, is devoid of recesses such as those which are formed by the grooves 26 in the front marginal portions of the side rails 22 of the reinforcing frame of the panel 14, the plywood panel 40 which is associated therewith extends in face-to-edge relationship with respect to each of the vertical frame members including the side rails 42, the vertical or side edges of the plywood panel terminating in the planes of the outer faces of the outer side rails 42. It is desirable in connection with a "Steel-Ply" concrete wall form panel that the vertical ribs 24 and 26 (see particularly FIG. 2) abut against the outer side rails 42 of any selected adjacent metal-clad panel structure, regardless of whether the latter be of the "Steel-Ply" or any other type. With a conventional "Versiform" concrete wall form panel, uninterrupted facing continuity between adjacent panels in the case of one "Steel-Ply" and one standard "Versiform" panel could only be attained by causing the edge of the five-ply facing of the "Versiform" panel to abut against the relatively narrow vertical rib 24 of the adjacent side rail 22 of the "Steel-Ply" panel. Such a steel-to-wood connection would obviously be impractical and unstable, especially since the side edges of the plywood facing of the "Versiform" panel is subject to chipping and deformation because it is not protected by metal as is the vertical edges of the plywood facing of a "Steel-Ply" panel. For this reason, at each of the juncture regions between the "Steel-Ply" panel 14 and the adjacent "Versiform" panel reinforcing frame, the rib 24 is caused to abut against the outside face of the adjacent side rail 42 as clearly shown in FIG. 2 and the five-ply plywood facing 40, instead of terminating flush with the edges of the frame structures, is continued across the normal concrete pouring face of the three-ply facing 20 of the "Steel-Ply" panel 14 and beyond such pouring face where it serves as the panel facings for the reinforcing frames of the "Versiform" panels 16 and 18. As will become readily apparent as the following description ensues, assembly of the composite concrete wall form unit or assembly 10 is accomplished by first joining the reinforcing frames of the "Steel-Ply" and "Versiform" panels together and, after the union thereof has been completed, applying the common five-ply plywood facing 40 across all three reinforcing frames. The common over-all plywood facing 40 is applied to the reinforcing or backing frames of the two "Versiform" panels 16 and 18 by means of rivets, bolts or the like 50 which pass through the vertical flange of the angle-shaped struts 46, as well as through the plywood facing 40.

As previously indicated, fastening of the vertical side rails 22 of the "Steel-Ply" panel 14 to the vertical outside side rails 42 of the reinforcing frames of the "Versiform" panels 16 and 18 is effected by means of a plurality of the aforementioned transition bolts 12 which are adapted to pass through selected slots 38 in the side rails 22 of the reinforcing frame of the "Steel-Ply" panel 14, and also through registering or mating vertically elongated slots 51 in the vertical outer side rails 42 of the reinforcing frames of the "Versiform" panels 16 and 18, such latter slots being arranged on twelve-inch centers as in the case of the slots 38.

Figure 2:
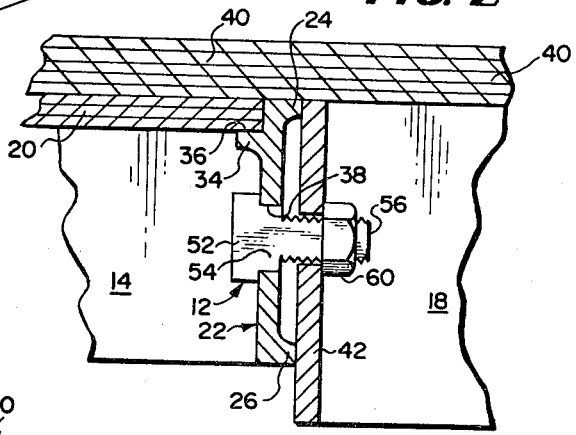
FIG. 2 is an enlarged horizontal sectional view taken on the line 2—2 of FIG. 1 and in the direction of the arrows.
Figure 3:
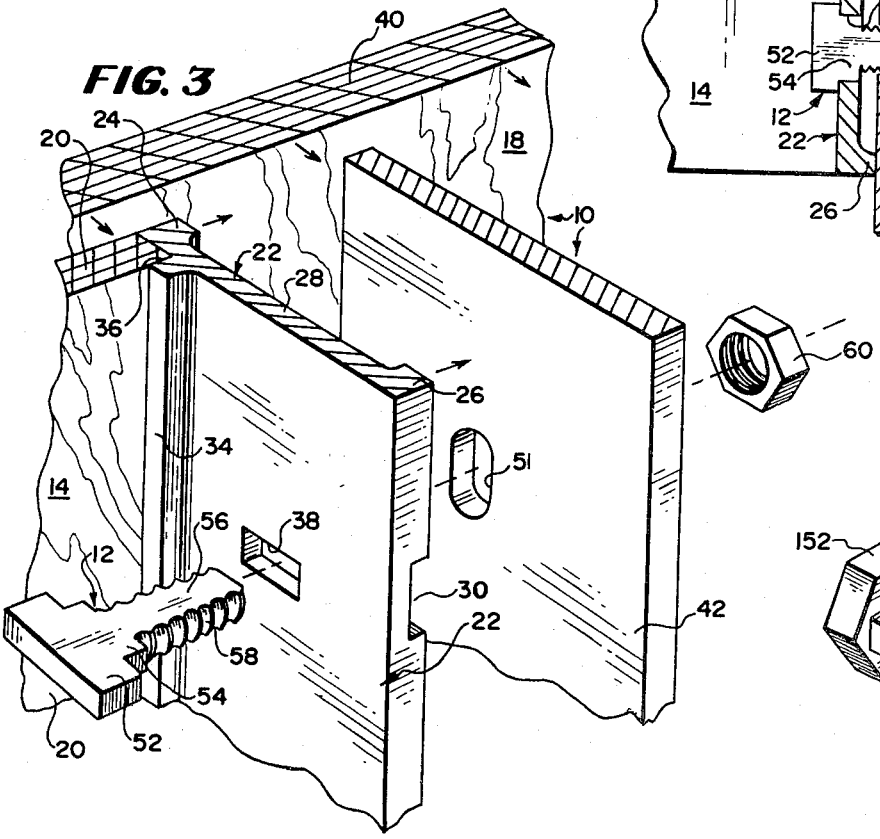
FIG. 3 is an exploded outside perspective view of the structure of FIG. 2.

The transition bolt 12 is best illustrated in FIG. 3 of the drawings. It is of one-piece character and comprises a flat-sided steel member which may be formed of flat bar stock and embodies an enlarged head 52, at one end thereof an intermediate shoulder portion 54 of intermediate or reduced size, and a further reduced shank portion 56 at its other end. The shoulder and shank portions 52 and 54 are adapted respectively to extend through the horizontally extending slot 38 in the side rail 22 and the mating vertically elongated slot 51 in the side rail 42 as shown in FIG. 2. The enlarged head portion 52 is adapted when the bolt is in its proper operative position to have its inner face abut flatly against the outer surface of the portion of the side rail 22 which defines the rectangular horizontally extending slot 38. The shoulder and shank portions of the bolt are flat-sided and have their sides coplanar. Such shank portion is provided with interrupted helical threads 58 on the narrow edges thereof, the threads on opposite sides of the shank portion extending throughout the length of said shank portion and extending, in effect, in continuity so that such shank portion 56 may receive thereover a conventional nut 60 in threaded relationship. The length of the shank portion 56 is greater than the depth of the slot 51 with the result that its outer end projects beyond said slot 51 and serves as a medium for carrying the nut 60. When the transition bolt 12 is in its operative position as shown in FIG. 2 and the nut 60 is tightened, the nut abuts against the outer surface of the adjacent portion of the side rail 42 and causes the inner surface of the head 52 to be clamped against the adjacent portion of the outer surface of the side rail 22. The bolt 12 may be manufactured by machining the same from flat bar stock or, alternatively, it may be machined by metal-removing operations in connection with a conventional hex-head type bolt.

In order to erect the composite concrete wall form unit or assembly 10 which is fragmentarily illustrated in FIG. 1 of the drawings, a standard "Steel-Ply" panel 14 is selected, as also are the reinforcing or backing frames of two "Versiform" panels such as the identical panels 16 and 18. The completely assembled "Steel-Ply" panel 14 including its plywood facing 20 is then bolted to the frame of the "Versiform" panel 18 in the manner illustrated in FIGS. 2 and 3, and that is by bringing one of the vertical side rails 22 of the reinforcing frame of the "Steel-Ply" panel into contiguity with the corresponding side rail 42 of the reinforcing frame of the "Versiform" panel 18 so that the various horizontal slots 38 register with the vertical slots 51, both sets of slots being vertically spaced on twelve-inch centers. Thereafter, the transition bolts 12 of the present invention are passed through selected pairs of registering slots 38 and 51 and then the nuts 60 are applied to the bolt shanks 58 and tightened in order to clamp the right side rail 22 of the reinforcing frame of the "Steel-Ply" panel 14 to the adjacent or left side rail 42 of the reinforcing frame of the "Versiform" panel. It will be noted that it is not necessary to apply a transition bolt 12 to each pair of registering slots 38 and 51, and that the number of employed transition bolts will depend upon the sizes of the two reinforcing frames which are to be connected together. It is also to be noted that the shoulder portions 54 of the transition bolts 12 are shaped correspondingly to and are substantially the same in depth as the horizontally extending rectangular slots 38 in the side rails 22 with the result that when the bolts 12 are in place said shoulder portions completely fill the slots in which they fit and, hence, preclude rotation of the bolts with respect to said side rails 22. After the panels 14 and 18 are bolted together as set forth above, the panels 14 and 16 are bolted together in the same manner.

With the entire "Steel-Ply" panel 14 including its three-ply plywood facing 20 thus secured to the reinforcing or backing frames of the two "Versiform" panels 16 and 18, the large five-ply plywood facing 40 is then applied to the frames of the two "Versiform" panels by riveting or bolting the same to the various right-angle frame bars or struts 46 in such a manner that it bridges the "Steel-Ply" panel 14 and its central or medial portion lies in face-to-face relationship with the three-ply facing 20 of said panel 14. With the composite concrete wall form unit or assembly 10 thus completed, erection of a concrete wall form may be effected by connecting the wall form side which includes the unit or assembly 10 to a similar opposed concrete wall form side by means of horizontal tie rods such as the tie rod 32.

It is pointed out at this time that the disclosure of FIG. 1 is representative of a fragmentary portion of one side of a concrete wall form which is comprised largely of "Versiform" panels which are arranged in edge-to-edge relationship, the "Steel-Ply" panel 14 constituting only a fill-in panel where an odd dimension is to be made up. The unit or assembly 10 which includes a single "Steel-Ply" panel 14 and two "Versiform" panels 16 and 18 may, therefore, be regarded as a single composite assembly which is to be used as one unit of the over-all concrete wall form.

Figure 4:
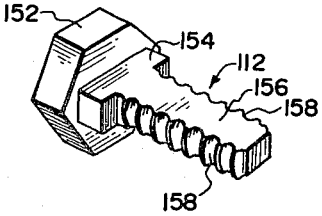
FIG. 4 is a perspective view of a slightly modified form of transition bolt which is capable of substitution for the transition bolt which is shown in FIGS. 1, 2, and 3.

In FIG. 4, a slightly modified form of transition bolt 112 is shown, such bolt being capable of substitution for the previously described bolt 12. The bolt 112 is similar to the bolt 12, the only difference being in the shape of the enlarged bolt head 152 which is hexagonal in nature instead of being flat as in the case of the bolt 12. In view of the similarity between the two bolts 12 and 112, and in order to avoid needless repetition of description, similar reference characters but of a higher order have been applied to the corresponding parts as between the disclosures of FIGS. 4 and 3.

It is to be noted that with either form of transition bolt 12 or 112, the inside surface of the enlarged head 52 or 152, as the case may be, will be drawn hard against the inside face of the adjacent side rail 22 of the reinforcing frame of the "Steel-Ply" panel 14 when the nut 60 is applied to the reduced flat shank portion of the bolt and then tightened.

The invention is not to be limited to the exact arrangement of parts shown in the accompanying drawings or described in this specification as various changes in the details of construction may be resorted to without departing from the spirit or scope of the invention. For example, although considerable novelty is predicated upon the use of either the transition bolt 12 or the transition bolt 112, novelty is also predicated upon the nature of the composite concrete wall form unit or assembly 10. Therefore, under certain circumstances, it may be deemed expedient to provide horizontally elongated slots in the side rails 42 of the reinforcing frames of the metal-clad panels 16 and 18 in place of the vertically elongated slots 52. In such an instance, adjacent side rails of the unit or assembly 10 may be connected together by bolt and wedge assemblies similar to those shown and described in aforementioned U.S. Pat. No. 2,948,095. The use of such bolt and wedge assemblies will not destroy the essential features of the unit or assembly 10 wherein the medial panel 14 preserves its own plywood facing 20 and also shares the over-all common plywood facing 40. Furthermore, it is within the scope of the present invention to utilize the bolts 12 or 112 and to adapt them for use with reaction wedges by slitting the shank portions thereof. In such an instance, the openings 38 in the side rails 22 would remain rectangular while the openings 52 in the side rails 42 would be made circular. Therefore, only insofar as the invention is particularly pointed out in the accompanying claims is the same to be limited.

Having thus described the invention what I claim as new and desire to secure by letters patent is:

1. A one-piece transition bolt adapted to clamp together the abutting side rails of a pair of edge-to-edge concrete wall form panels or the like and further adapted to extend through a rectangular transversely extending slot in one of the rails and a registering longitudinally extending slot in the other side rail, said bolt comprising an enlarged head at one end thereof, a reduced intermediate shoulder portion, and a further reduced shank portion at its other end, said enlarged head portion being adapted when the bolt is in its proper operative position to have its inner face abut flatly against the outer surface of the portion of the one side rail which defines said rectangular transversely extending slot, said shoulder and shank portions being flat-sided, having their sides coplanar, and being adapted respectively to extend through the first and second mentioned slots in the two rails, the shoulder portion being shaped correspondingly to and of substantially the same depth as the rectangular transversely extending slot in said one rail to the end that when the bolt is in its operative position the shoulder portion fits snugly in the last mentioned slot and thus positively holds the bolt against rotation or angular displacement with respect to said rails, said shank portion being of greater length than the depth of the longitudinally extending slot in the other rail, having interrupted screw threads on its edges throughout its entire length and being adapted to receive on its outer projecting end an internally-threaded nut which when tightened abuts against the outer surface of the adjacent portion of said other side rail and causes said inner surface of the head of the bolt to be clamped against the aforesaid portion of the outer surface of said one side rail.

2. A transition bolt according to claim 1 and wherein the bolt is formed of bar stock and the enlarged head thereof is flat-sided, has its sides flush with those of the shoulder and shank portions, and is of slightly greater depth than said shoulder portion.

* * * * *